US006443339B1

(12) United States Patent
Higuchi

(10) Patent No.: US 6,443,339 B1
(45) Date of Patent: Sep. 3, 2002

(54) BABY CARRIER USED FOR HOLDING BABY IN BOTH FACE-TO-FACE AND FORWARD-FACING MANNERS

(75) Inventor: Junichi Higuchi, Gifu (JP)

(73) Assignee: Lucky Industry Company, Ltd., Ibigun (JP)

( * ) Notice: Subject to any disclaimer, the term of this patent is extended or adjusted under 35 U.S.C. 154(b) by 0 days.

(21) Appl. No.: 09/645,576

(22) Filed: Aug. 25, 2000

(30) Foreign Application Priority Data

Sep. 1, 1999 (JP) ..... 11-246877

(51) Int. Cl.[7] ..... A61G 1/00

(52) U.S. Cl. ..... 224/160; 224/158; 224/159; 224/161

(58) Field of Search ..... 224/160, 158–161

(56) References Cited

U.S. PATENT DOCUMENTS 4,986,458 A * 1/1991 Linday ..... 224/160
5,205,450 A * 4/1993 Derosier ..... 224/161
5,205,451 A * 4/1993 Manzer ..... 224/161
5,490,620 A * 2/1996 Bergqvist ..... 224/160
5,678,739 A * 10/1997 Darling et al. ..... 224/160

* cited by examiner

*Primary Examiner*—Stephen K. Cronin
*Assistant Examiner*—Maerena W. Brevard
(74) *Attorney, Agent, or Firm*—Armstrong, Westerman & Hattori, LLP

(57) ABSTRACT

A baby carrier used for holding a baby in both face-to-face and forward-facing manners includes a carrier body 10 for accommodating a body of a baby and a wearing member 30 secured to the carrier body 10 for wearing the carrier body on a body of a user. The carrier body 10 includes at least a back rest 11 and is capable of accommodating and holding a baby in both a face-to-face holding manner in which the baby is held such that the back rest 11 is brought into contact with the back of the baby and a forward-facing holding manner in which the baby is held such that the back rest 11 is brought into contact with the chest and abdomen of the baby. The back rest 11 includes a width-reducing member 50 for reducing a width of a lower portion of the back rest 11, to be located between legs of the baby when the baby is held in a forward-facing holding manner.

23 Claims, 7 Drawing Sheets

BABY CARRIER USED FOR HOLDING BABY IN BOTH FACE-TO-FACE AND FORWARD-FACING MANNERS

BACKGROUND OF THE INVENTION

1. Field of the Invention

The present invention relates to a baby carrier used for holding a baby while walking, and more particularly, to a baby carrier suitably used for holding a baby in both a face-to-face manner and a forward-facing manner.

2. Description of Related Art

As one of baby carriers used for holding a baby while walking, a baby carrier for holding a baby in front of a user is known. A common manner for holding a baby is to hold the baby in a face-to-face manner such that the baby and the user face to each other as shown in FIG. 7A. In the face-to-face holding manner, since the user can always check the baby's condition and the baby is watched by the user, both of them can obtain a strong sense of security. Furthermore, when the baby is sleepy, it can lean on the user and sleep in a comfortable position. Also, when the user supports the baby by arms in addition to the baby carrier, the baby can be stably supported. Therefore, most baby carriers employ a structure suitable for holding a baby in a face-to-face manner so as to entirely cover the baby from its back to its buttocks.

By the way, a baby is by nature full of curiosity and shows interest in the surroundings. However, in the case of the face-to-face holding manner, since the user interrupts the baby's visual field, the baby cannot fully satisfy its curiosity. Furthermore, when the baby is held in the same position for a long time, it gets tired of being held. For this reason, as shown in FIG. 7B, there is an increasing tendency-to prefer holding a baby in a "forward-facing manner" in which the baby is faced to the same direction as the user to widen its visual field. Of course, since the face-to-face holding manner is superior to the forward-facing holding manner in view of the psychological and physical stabilities, a user does not always hold the baby in the forward-facing holding manner, but properly switches the holding manners in accordance with the baby's conditions.

For this reason, a user uses the same baby carrier used for holding a baby in the face-to-face holding manner when holding the baby in the forward-facing manner. The accommodating direction of the baby has been turned around with respect to a carrier body.

In FIGS. 7A and 7B, the reference numerals 10, 11, 13, 15, 16, 30 and 31 denote a carrier body, a back rest, a head rest, a pocket, a back-width adjusting member, shoulder belts and straps on tip ends of the shoulder belts, respectively.

However, when the baby carrier originally designed for holding a baby in the face-to-face manner is used for holding the baby in the forward-facing manner, the following problems have been raised.

A human's upper part of the body and upper and lower limbs bend forward (thoracicoabdominal direction), and an outer length of the body in the bending direction is longer than an inner length of the body. In order to stably hold such a human body, or a baby, in the carrier body 10, the back rest 11 for supporting the baby from its back to its buttocks is formed wide and a crotch rest for supporting the baby from its lower abdomen to its inguinal region is formed slightly narrower. When such a baby carrier is used for holding a baby in the face-to-face manner, it is possible to entirely cover the baby from its back to its buttocks, resulting in a stable holding of the baby. However, when the baby is turned around to the opposite direction so as to be held in the forward-facing manner, the legs of the baby project from lower edges of the back rest 11 toward a back of the back rest in a slightly bending state. Thus, a lower portion of the wide back rest 11 supports the baby from its lower abdomen to its inguinal region. Furthermore, since the carrier body 10 is suspended, a weight of the baby is concentrated to the lower portion of the back rest 11. This causes the lower edges of the back rest 11 to press or bite into the inguinal region of the baby. Moreover, in the case of the forward-facing holding manner, since a baby can move its arms and legs more freely as compared with in the face-to-face holding manner, the pressure applied to the inguinal region of the baby becomes stronger.

SUMMARY OF THE INVENTION

In view of the above backgrounds, it is an object of the present invention to provide a baby carrier used for holding a baby safely and comfortably in both face-to-face and forward-facing manners.

To achieve the above object, a baby carrier used for holding a baby in both face-to-face and forward-facing manners according to the present invention includes a carrier body 10, 70 for accommodating a body of a baby, and a wearing member 30, 80, 85 secured to the carrier body 10, 70 for wearing the carrier body 10, 70 on a body of a user. The carrier body 10, 70 includes at least a back rest 11, 71, and is capable of accommodating and holding a baby in both a face-to-face holding manner in which the baby is held such that the back rest 11, 71 is brought into contact with the back of the baby and a forward-facing holding manner in which the baby is held such that the back rest 11, 71 is brought into contact with the chest and abdomen of the baby. The back rest 11, 71 includes a width-reducing member 50, 60, 44, 90 for reducing the width of a lower portion of the back rest to be located between legs of the baby when the baby is held in a forward-facing holding manner.

It is preferable that the width-reducing members 50, 60, 90 includes a pair of right and left annular members attached to the back of the back rest 11, 71 so as to be apart from each other at a predetermined distance and a gathering member for bringing the annular members close to each other by engaging with the annular members.

The annular member may be a loop-shaped member 51 made of soft material or a ring 61, 91 made of hard material.

The gathering member may be a string 52 passed through the annular members for bringing the annular members close to each other by tightening thereof, or a double hook member 62, 92 having hooks 64, 93 at its right and left opposite ends, whereby the double hook member 62, 92 brings the annular members into a closed state when the double hook member is hooked on the annular members.

Further, the gathering member may be fixed to outside of the back rest 11 between the right and left annular members, or may be detached from the back rest 71.

The width-reducing member may be separated and independent from the carrier body 10, and may be a belt 44 to be wound and fastened into a state in which the belt 44 gathers up the back rest 11. Further, the belt 10 may be attached to a pad 40 which is to be accommodated in the carrier body 10 for protecting the chest and abdomen of the baby.

BRIEF DESCRIPTION OF THE DRAWINGS

The present invention will be more fully described and better understood from the following description, taken with the appended drawings, in which:

FIGS. 2A and 2B are front views of essential portions showing a usage pattern of the baby carrier used for holding a baby in both face-to-face and forward-facing manners, wherein FIG. 2A shows the face-to-face holding manner, and FIG. 2B shows the forward-facing holding manner;

FIGS. 3A and 3B are front views of essential portions of the baby carrier used for holding a baby in both face-to-face and forward-facing manners according to a second embodiment, wherein FIG. 3A shows a state suitable for the face-to-face holding manner, and FIG. 3B shows a state suitable for the forward-facing holding manner;

FIGS. 5A and 5B are front views of essential portions of the baby carrier used for holding a baby in both face-to-face and forward-facing manners according to a fourth embodiment, wherein FIG. 5A shows a state suitable for the face-to-face holding manner, and FIG. 5B shows a state suitable for the forward-facing holding manner;

FIGS. 7A and 7B are perspective views showing a usage pattern of a conventional baby carrier, wherein FIG. 7A shows the face-to-face holding manner, and FIG. 7B shows the forward-facing holding manner.

DETAILED DESCRIPTION OF THE PREFERRED EMBODIMENT

Four preferred embodiments of the present invention will now be described with referenced to the accompanying drawings.

[First Embodiment]

Figure 1:
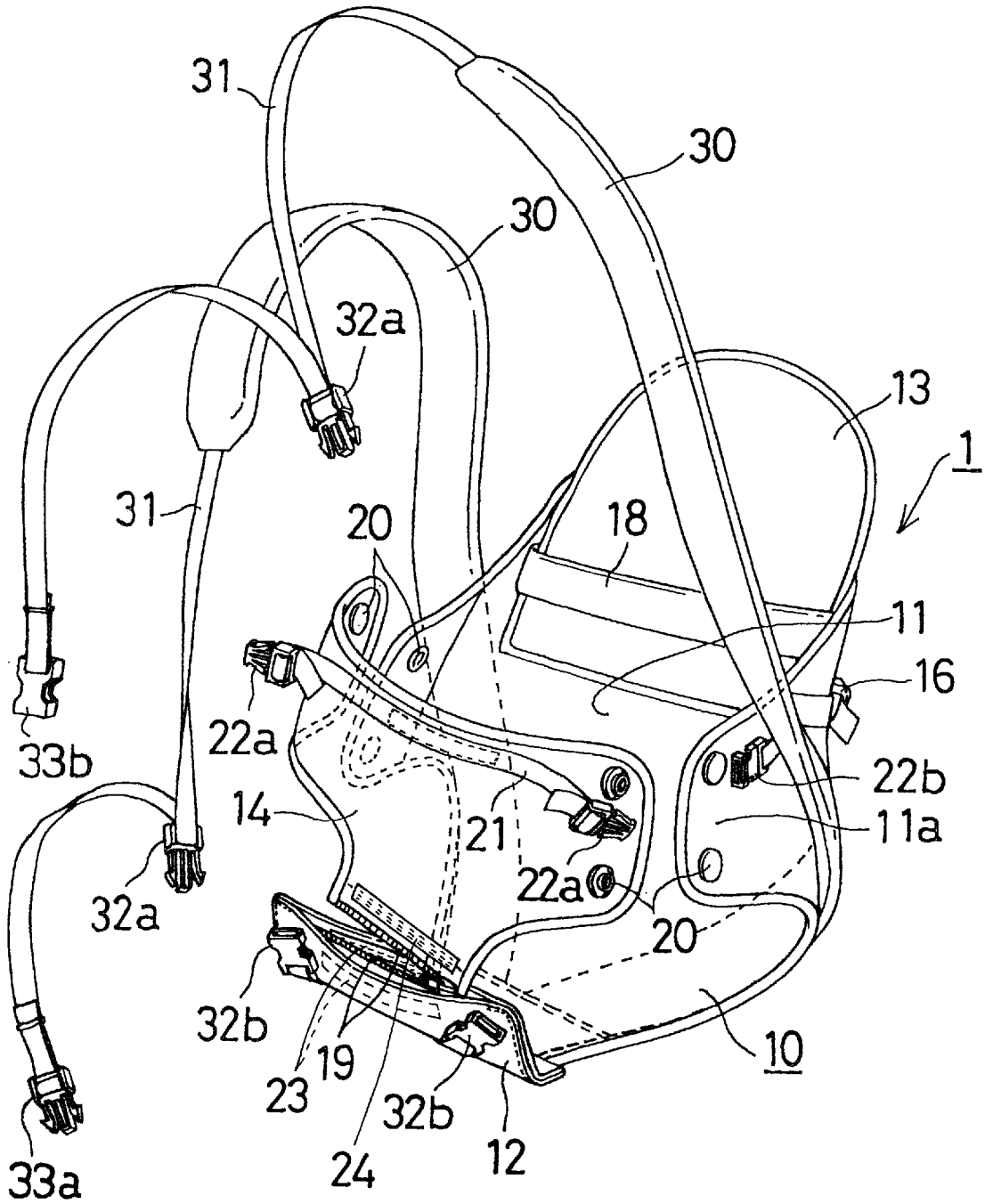
FIG. 1 is a perspective view of an entire baby carrier used for holding a baby in both face-to-face and forward-facing manners according to a first embodiment according to the present invention.
Figure 2B:
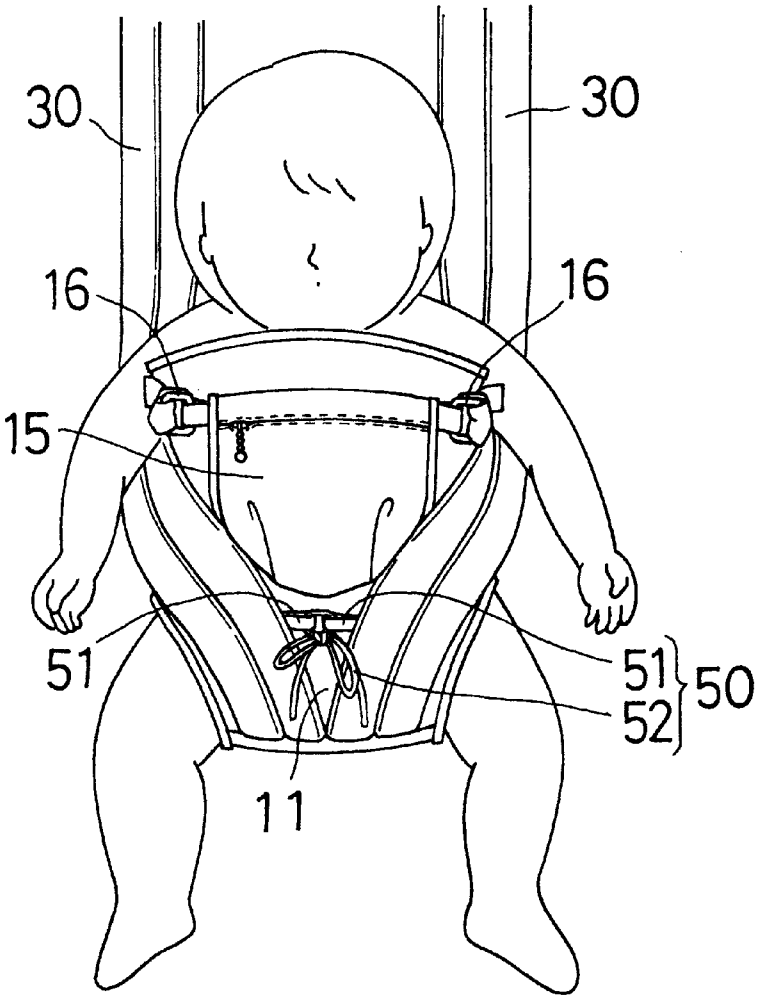
Figure 2A:
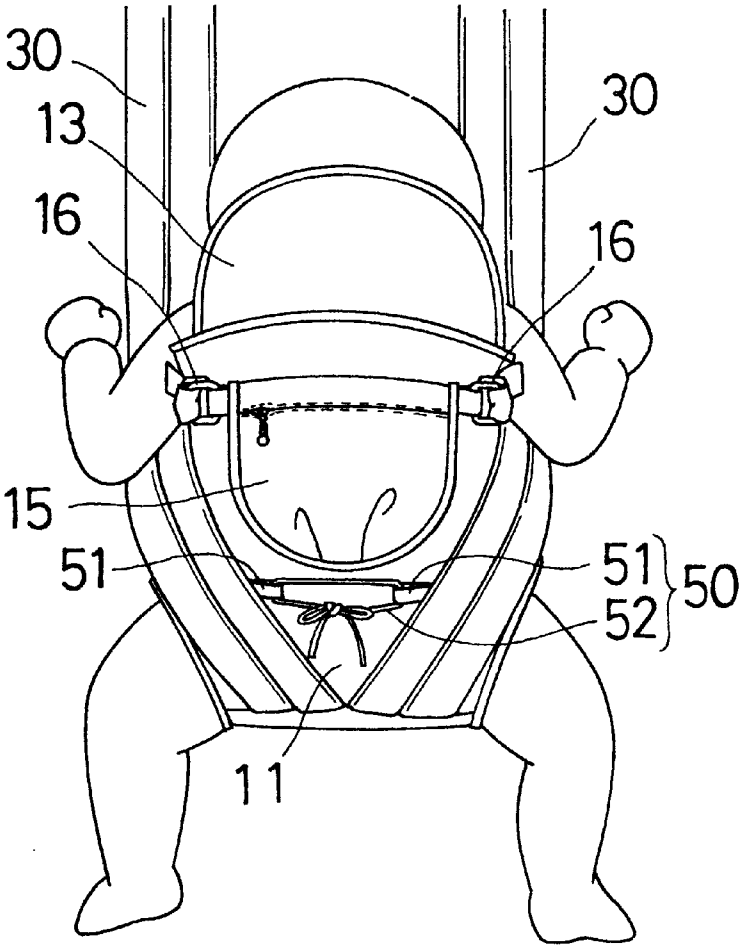

As shown in FIGS. 1, 2A and 2B, a baby carrier 1 includes a carrier body 10 and shoulder belts 30, and can be used in four manners, i.e., a face-to-face holding manner, a forward-facing holding manner, a carrying-on-user's back manner, and a carrying on-user's side manner.

The carrier body 10 includes a back rest 11 for covering the baby from its back to its buttocks when the baby is held in the face-to-face manner, a wide band-like crotch rest 12 which is continuously formed on a lower end of the back rest 11 and has a substantially U-shape when seen from its side, and a front rest 14 which is detachably attached to the crotch rest 12 and is generally T-shaped as seen from its front.

On an outer surface of the back rest 11, a pocket 15 is sewn for accommodating small articles. A back-width adjusting member 16 for adjusting a width of the back rest 11 is sewn on opposite sides of the pocket 15, and a width-reducing member 50 for reducing a width of a lower portion of the back rest 11 to be located between both legs of the baby when the baby is held in a forward-facing manner is provided at a lower portion of the pocket 15. In the present embodiment, the back-width adjusting member 16 includes two D-rings and an adjusting belt passed through these D-rings to be tied. The width-reducing member 50 includes a pair of right and left loops 51 and 51 and a string 52 passed through the loops 51 and 51. Each loop 51 is made of a narrow band-shaped cloth with opposite ends thereof sandwiched and sewn in the corresponding shoulder belt 30. When the string 52 is tightened and tied, both loops 51 and 51 approach each other to shorten the crotch-width, i.e., the width of the lower portion of the back rest 11 as shown in FIG. 2B, and when the string 52 is loosened and tied, the crotch-width is widened to return to the original width of the back rest 11 as shown in FIG. 2A.

The crotch rest 12 is formed to have a bag-like shape having an opening at its front end which can be opened and closed by a face fastener 23. The crotch rest 12 includes a zipper 19 therein for connecting the front rest 14.

The front rest 14 having a generally T-shape as seen from its front is provided with a zipper 19 at its lower end edge and is detachably connected to the portion near the front end edge in the bag of the crotch rest 12 by the zipper 19. Also, the front rest 14 is provided at its upper opposite edges with two pairs of upper and lower catches 20 and 20 such as snap fasteners and detachably connected to tip ends of opposite ears 11*a* and 11*a* of the back rest 11. A face fastener 24 corresponding to the face fastener 23 for opening and closing the crotch rest 12 is sewn on both an upper portion of front and back surfaces of the zipper 19 so that the opening of the crotch rest 12 can be closed even when the front rest 14 is used by engaging the face fasteners 23 and 24. When the front rest 14 is not used, it can be removed from the carrier body 10 by unzipping the zipper 19, or the front rest 14 can be accommodated in the bag of the crotch rest 12.

On the upper outer surface of the front rest 14, a middle portion of a single safety auxiliary belt 21 is laterally sewn. This auxiliary belt 21 is provided as a safeguard in the unlikely event that the catches 20 and 20 of the upper portions of the front rest 14 are disengaged, and first buckles 22*a* and 22*a* of the safety auxiliary belt 21 can be connected to second buckles 22*b* and 22*b* mounted to outer surfaces of the ears 11*a* and 11*a* of the back rest 11.

Therefore, the carrier body 10 can be changed into a bag-like type in which a baby can be accommodated and held in the carrier body 10 by connecting the front rest 14 to the crotch rest 12 and the back rest 11, and into an open type for holding the baby while loosening the restraint of the front side of the baby by separating the front rest 14. The bag-like type baby carrier has an advantage that a baby who has not yet grown sufficient can be held safety and stably. On the other hand, the open type baby carrier has an advantage that a baby who has slightly grown or a baby padded in heavy clothes can be held loosely.

A head rest member 13 is a plate-like member for supporting and stabilizing a baby from its neck to its head, and is detachably attached to the back rest 11 in an upwardly protruding state by both catches such as snap fasteners and a pressure band 18.

A base portion of each of the right and left pair of shoulder belts 30 is overlapped and sewn on a back of the back rest 11 into a substantially V-shape as seen from its behind, and the shoulder belts 30 are drawn upward from the upper side edge of the back rest 11. A portion of each of the shoulder belts 30 which is in touch with the shoulder of the user is formed into a wide band-like shape, and tip ends thereof are formed of narrower straps 31 and 31.

On the straps 31 and 31 of the tip end side of the shoulder belts 30 and 30, third buckles 32*a* and 32*a* are attached to middle portions of the straps 31 and 31 such that the attaching positions can be changed by sliding motion. These third buckles 32*a* and 32*a* are engaged with fourth buckles 32*b* and 32*b* attached to opposite side edges of a front outer surface of the crotch rest 12. The third buckles 32*a* and 32*a* and the fourth buckles 32*b* and 32*b* can be detachably connected to each other. The pairs of fifth and sixth buckles 33*a* and 33*b* are attached to the tip ends of the straps 31 and 31 of the shoulder belts 30 and 30 such that the fifth and sixth buckles 33*a* and 33*b* can be connected to each other.

The shoulder belts 30 and 30 are to wear the carrier body 10 on the user by being suspended on both shoulders of the user. Thus, the shoulder belts 30 and 30 correspond to the wearing member defined in the present invention.

Next, a method for using the baby carrier 1 in the face-to-face holding manner and the forward-facing holding manner will be explained.

(Face-to-face Holding Manner)

First, the head rest member 13 is mounted to the back rest 11 of the carrier body 10. The positions of the third buckles 32*a* and 32*a* attached to the middle portions of both shoulder belts 30 and 30 are adjusted by sliding so as to obtain an appropriate length for suspending on the shoulders of the user. Further, as shown in FIG. 2A, the string 52 of the width-reducing member 50 of the back rest 11 is loosened to have the back rest 11 its original width.

Then, when the carrier body 10 is used in the bag-like type, the front rest 14 is connected to the crotch rest 12, a baby is placed such that the back of the baby is in contact with the back rest 11, and then, the front rest 14 is connected to the back rest 11 to form the carrier body 10 into the bag-like shape, resulting in an accommodation of the baby in the bag-like shaped portion.

The carrier body 10 is positioned on the chest side of the user in this state, the shoulder belts 30 and 30 are suspended on both shoulders of the user and crossed on the back side, and the third buckles 32*a* and 32*a* are connected to the corresponding fourth buckles 32*b* and 32*b*. When remaining portions of the straps 31 and 31 at the tip ends of the third buckles 32*a* and 32*a* are sufficiently long, the remaining portions are wound around the waist of the user, and the pairs of fifth and sixth buckles 33*a* and 33*b* on their tip ends are connected to each other.

(Forward-facing Holding Manner)

As shown in FIG. 2B, the string 52 of the width-reducing member 50 is tightened to bring the loops 51 and 51 closer to each other, thereby reducing the crotch-width, and the head rest member 13 is removed because the head rest member 13 covers the face of the baby. Since the moving amount of the baby is large when the baby is held in the forward-facing manner, it is preferable that the width of the back rest 11 is slightly increased by the back-width adjusting member 16 on the back of the back rest 11.

Like in the aforementioned face-to-face holding manner, the front rest 14 is mounted in the case of the bag-like type, so that the baby is accommodated in a direction in which the chest of the baby comes into contact with the back rest 11. After the baby is accommodated in the carrier body 10, the shoulder belts 30 and 30 are worn on the body of the user as in the case of the face-to-face holding.

In the forward-facing holding manner, both legs of the baby project from the opposite edges of the lower portion of the back rest 11, but since the crotch-width is reduced by the width-reducing member 50, the back rest 11 does not bite into and press the inguinal region of the baby.

Furthermore, it is possible to use the baby carrier to carry the baby on the back of the user when the carrier body 10 is disposed on the back of the user and the shoulder belts 30 and 30 are suspended on both shoulders of the user. It is also possible to use the baby carrier to hold the baby horizontally when both of the two shoulder belts 30 and 30 are suspended on one of the shoulders of the user.

[Second Embodiment]

A baby carrier of a second embodiment is different from the baby carrier of the first embodiment only in the width-reducing member.

Figure 3B:
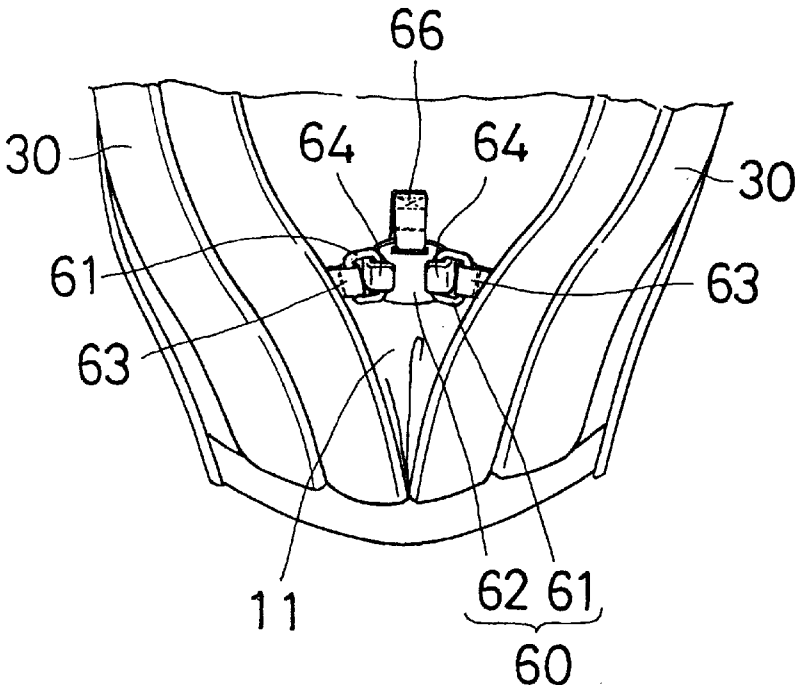
Figure 3A:
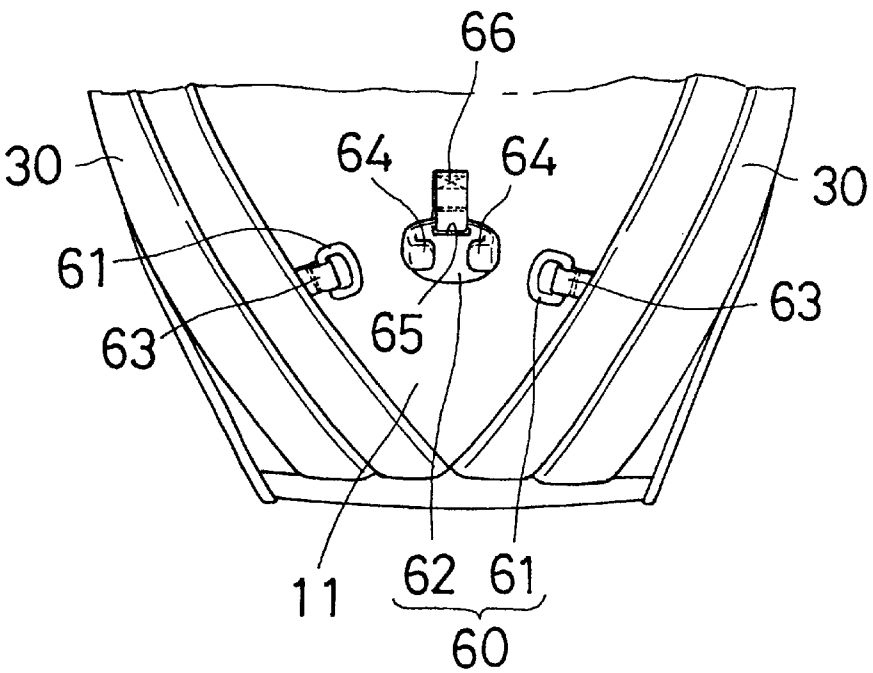

As shown in FIGS. 3A and 3B, a width-reducing member 60 includes a pair of right and left D-rings 61 and 61 and a double hook member 62 to be hooked to the D-rings 61 and 61.

Each D-ring 61 is attached to the back rest 11 in such a manner that a tape 63 passed through the D-ring 61 is sandwiched and sewn in the shoulder belt 30. The double hook member 62 includes hooks 64 and 64 to be hooked to the rings 61 and 61 at its opposite right and left ends and a mounting flat hole 65 at its upper portion. By sewing the tape 66 passed through the mounting flat hole 65 onto a middle portion between the right and left D-rings 61 and 61, it is mounted such that it is suspended from the back rest 11.

In the aforementioned width-reducing member 60, when the hooks 64 and 64 are hooked to the right and left D-rings 61 and 61, the D-rings 61 and 61 approach each other to reduce the crotch-width as shown in FIG. 3B, and the baby carrier is brought into a state suitable for holding a baby in the forward-facing manner. On the contrary, when the hooks 64 and 64 are detached from the D-rings 61 and 61, the crotch-width is increased and the back rest 11 is returned to its original width as shown in FIG. 3A, and the baby carrier is brought into a state suitable for holding a baby in the face-to-face manner. In this manner, the baby carrier can be switched between the face-to-face manner and the forward-facing manner only by the simple operation, i.e., by detaching the hooks 64 from the D-rings 61 and attaching the hooks 64 to the D-rings 61.

Since the double hook member 62 of the present embodiment is fixed to the back rest 11, the crotch-width is uniformly reduced, even if the baby moves, the baby can stably be held in the forward-facing manner.

[Third Embodiment]

A baby carrier of a third embodiment is different from the first embodiment only in the width-reducing member.

The width-reducing member of the present invention is not limited to the ones partially or entirely fixed to the back rest shown in the previous two embodiments.

For example, the crotch-width can be reduced even by winding and tightening a belt which is not fixed to but separated and independent from the back rest 11 in a state in which the back rest is gathered up. With the width-reducing member which is separated and independent from the carrier body, it is possible to reduce the crotch-width without changing the existing baby carrier.

Figure 4:
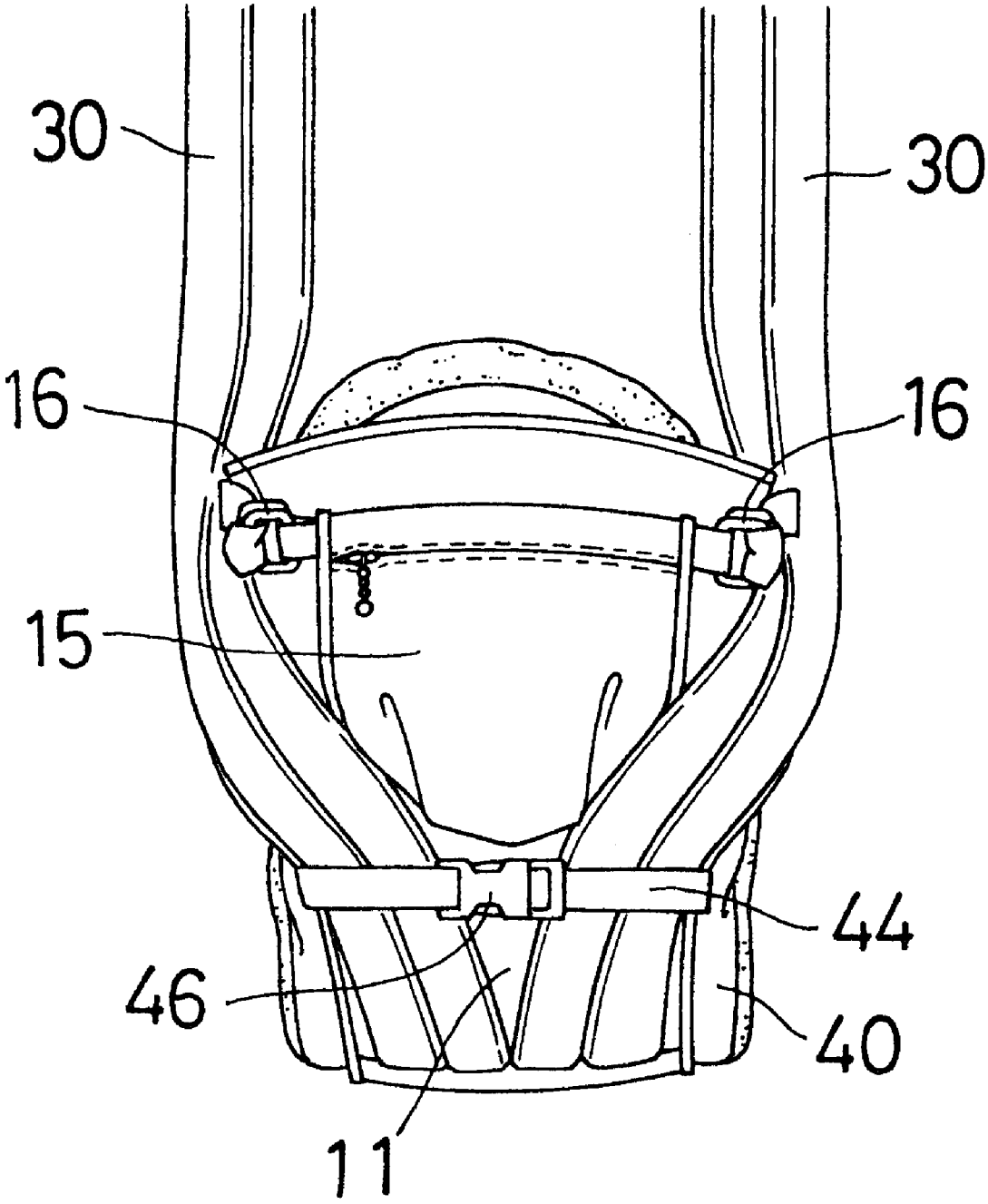
FIG. 4 is a front view of an essential portion of the baby carrier used for holding a baby in both face-to-face and forward-facing manners according to a third embodiment, showing a state in which a width of a crotch rest is reduced by a belt.

Further, as shown in FIG. 4, a pad 40 for protecting the chest and abdomen of the baby is additionally mounted to an inner surface of the back rest 11, a belt 44 is mounted to the pad 40, and the crotch-width can be adjusted to a desired width by the belt 44. In FIG. 4, the pad 40 is wound and fastened around the back rest 11 by fastening the buckles 46 attached to the tip ends of the belt 44. Because of the pad 40, in addition to reducing the crotch-width by the belt 44, the pressure to the inguinal region and the impact from outside can be reduced, resulting in a further enhanced safety of the forward-facing holding manner. Furthermore, since the belt 44 is wound and fastened, the pad 40 is prevented from deviating. When the pad 40 is formed to have a width slightly wider than the reduced crotch-width, the inguinal region of a baby can be further protected.

[Fourth Embodiment]

Figure 5B:
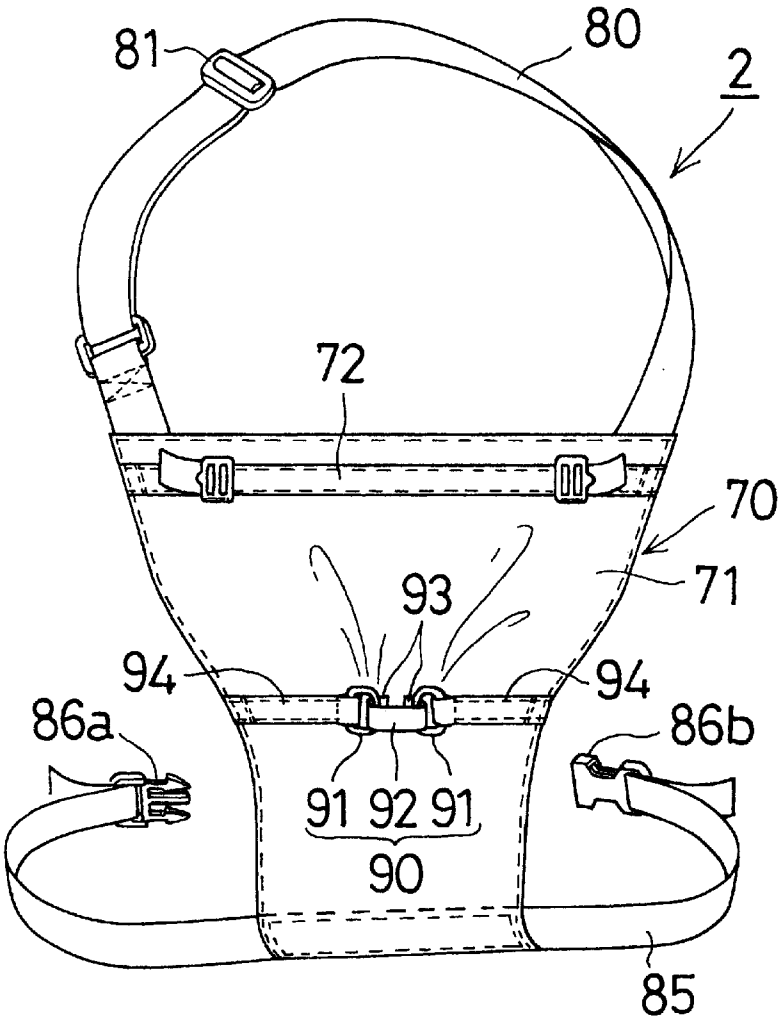
Figure 5A:
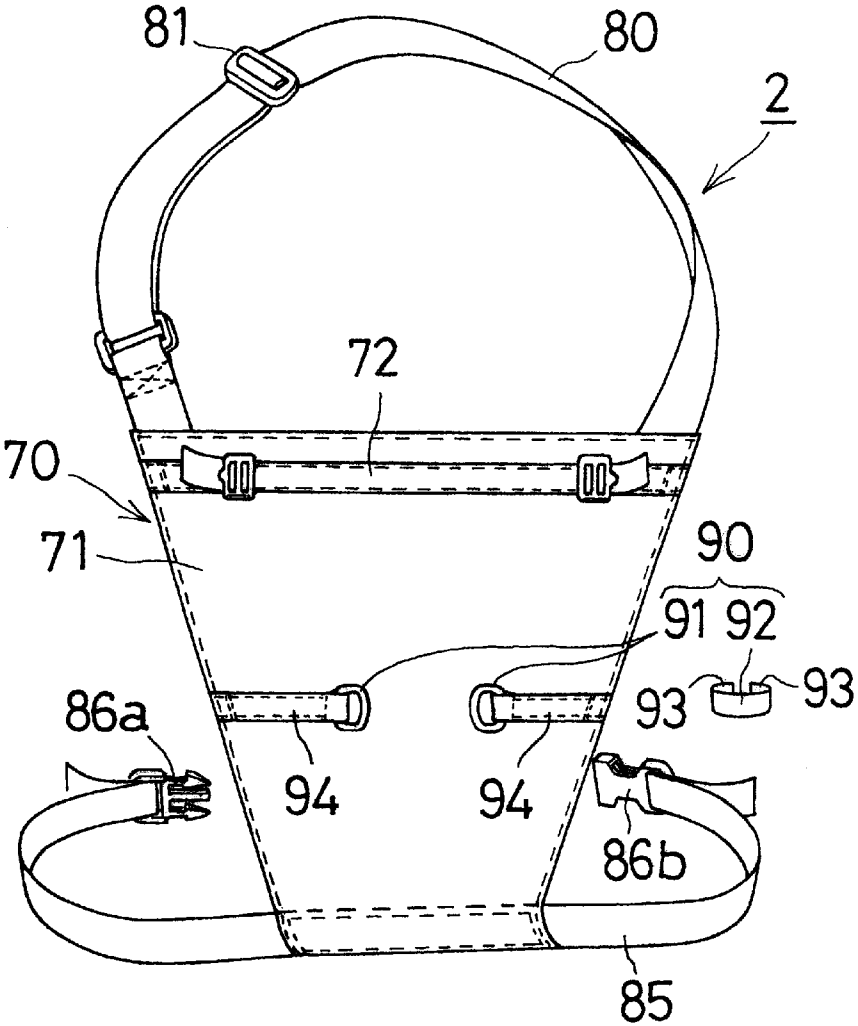
Figure 6:
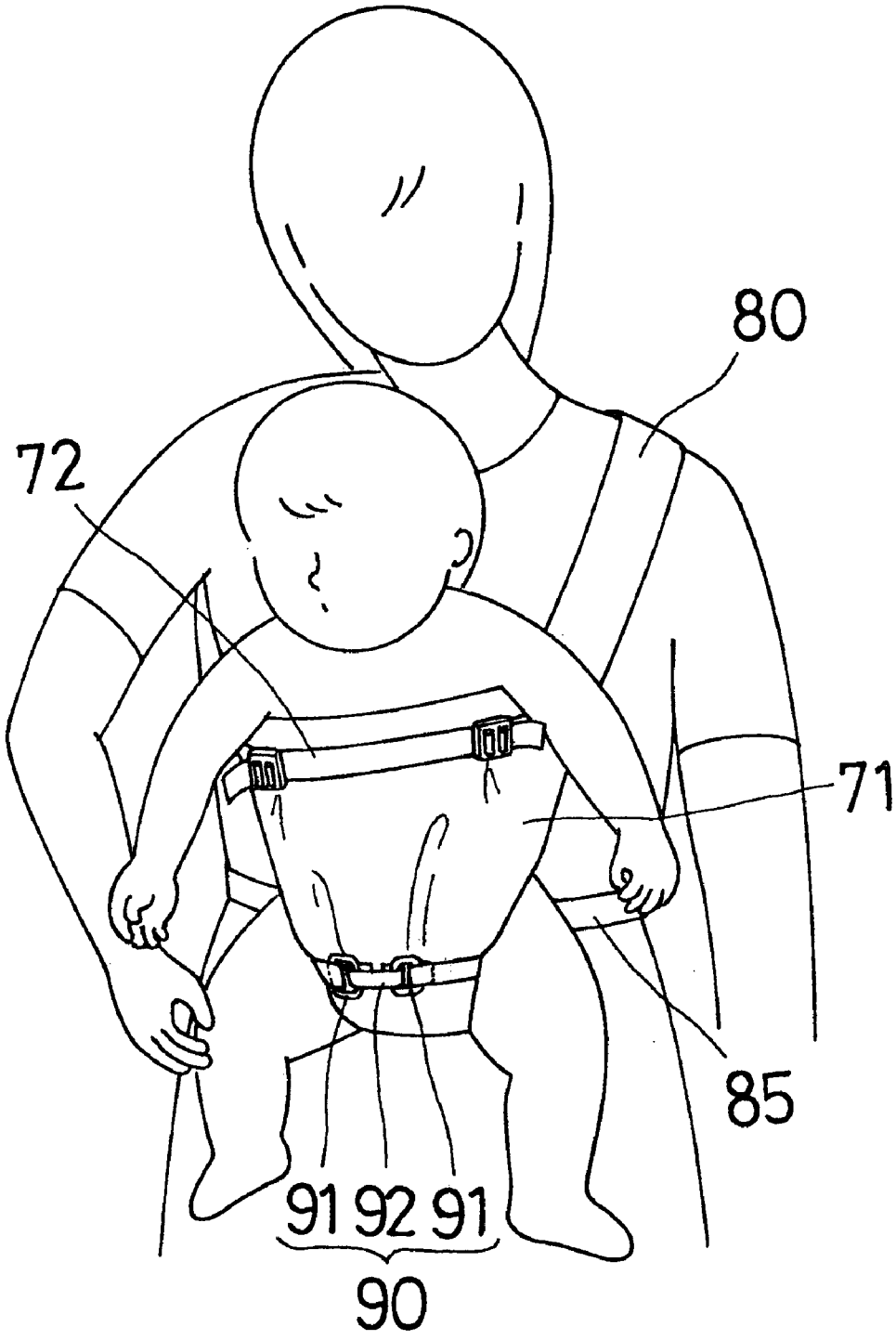
FIG. 6 is a perspective view showing a usage pattern in the forward-facing holding manner of the baby carrier used for holding a baby in both face-to-face and forward-facing manners according to the fourth embodiment.
Figure 7B:
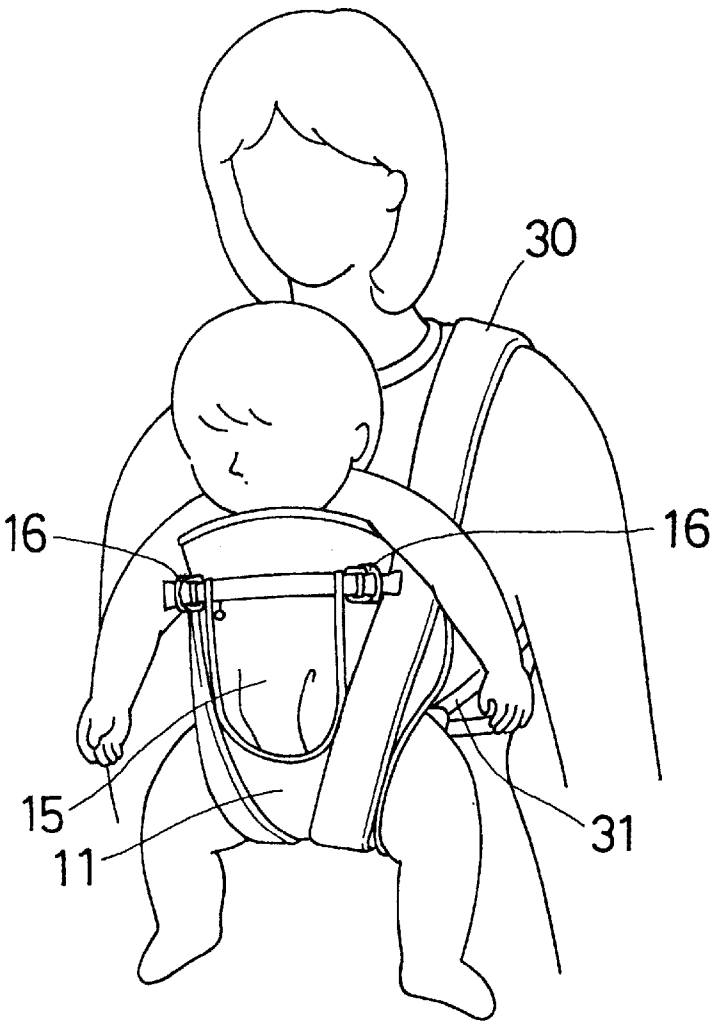
Figure 7A:
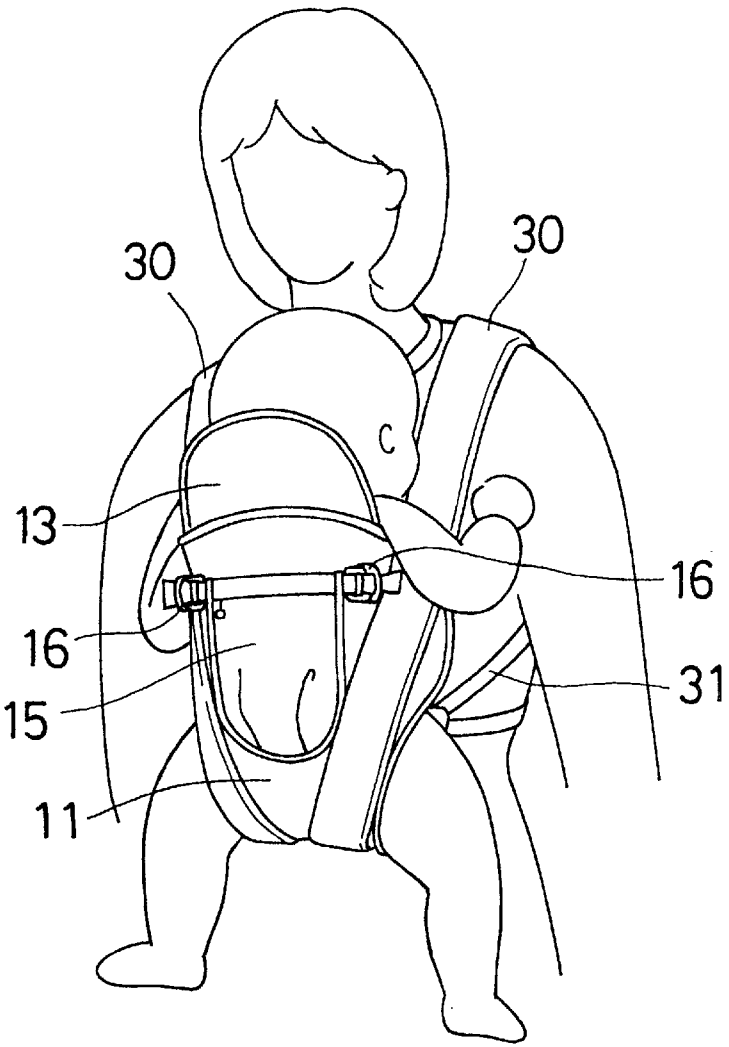

A baby carrier 2, as shown in FIGS. 5A, 5B and 6, includes a carrier body 70, a shoulder belt 80 and a waist belt 85. The baby carrier 2 can be used to hold a baby in both face-to-face and forward-facing manners more simply than the baby carrier 1 of the aforementioned first, second and third embodiments.

The carrier body 70 includes a back rest 71 having a length which covers a baby from its back to its buttocks in the face-to-face holding manner. The upper end portion of the back rest 71 is formed slightly wide so as to support the baby from its back to its sides, and the lower end portion of the back rest 71 is formed slightly narrow so as to easily project the legs of the baby in the right and left directions. Therefore, the back rest 71 is formed into a generally reversed trapezoidal shape.

On the upper end of the outer surface of the back rest 71, a back-width adjusting member 72 for increasing and decreasing the width of the back rest 71 is sewn. On a generally longitudinal middle portion of the outer surface of the back rest 71, a width-reducing member 90 is provided in order to reduce the crotch-width of the lower portion of the back rest 71 to be disposed by the inguinal portion of the baby when the baby is held in the forward-facing manner.

The width-reducing member 90 includes a pair of right and left D-shaped rings 91 and 91 and a double hook member 92 having right and left hooks 93 and 93 to be hooked to the rings 91 and 91. Each ring 91 is mounted to the back rest 71 with the tape 94 through the ring 91 sewn to the back rest 71. Thus, the rings 91 and 91 are apart from each other at a predetermined distance in the width direction of the back rest 71. The double hook member 92 is not fixed to the back rest 71, and is separated and independent from the back rest 71. In the width-reducing member 90, like the width-reducing member 60 in the aforementioned second embodiment, the crotch-width can be reduced by approaching the rings 91 and 91 and hooking the double hook member 92 to the right and left rings 91 and 91. Unlike in the second embodiment, the double hook member 92 is not fixed to the back rest 71, and can be removed from the back rest 71 when the baby carrier is used in the face-to-face holding manner.

Both ends of the shoulder belt 80 are sewn to the upper right and left ends of the back rest 71 respectively, and the shoulder belt 80 is suspended on one of the shoulders of the user. In FIGS. 5A and 5B, the reference numeral 81 denotes a length-adjusting member for adjusting the length of the shoulder belt 80.

A middle portion of the waist belt 85 is sewn to the lower end of the back rest 71. The waist belt 85 has a pair of buckles 86*a* and 86*b* at its opposite ends to be detachably connected each other.

Next, the method for using the baby carrier 2 will now be explained.

In the case of a face-to-face holding manner, as shown in FIG. 5A, the width of the back rest 71 is kept its original width by unhooking the double hook member 92 from the rings 91. On the other hand, in the case of a forward-facing holding manner, as shown in FIG. 5B, the crotch-width is reduced by hooking the double hook member 92 to the right and left rings 91 and 91. Also, the shoulder belt 80 is adjusted long in order to accommodate a baby easily. Then, the waist belt 85 is wound around the waist of the user so as to dispose the back rest 71 on the abdomen side of the user, and the buckles 86*a* and 86*b* are connected to tightly fasten the waist belt 85 around the waist of the user.

Thereafter, the baby is accommodated in the back rest 71 in either a face-to-face or a forward-facing direction, and the shoulder belt 80 is suspended on one of the shoulders of the user. Then, the length of the shoulder belt 80 is adjusted to have an appropriate length by the length-adjusting member 81 such that the back rest 71 is drawn to the body of the user in a suspending manner. In other words, the waist belt 85 supports the lower end of the back rest 71 on the abdomen of the user, and the shoulder belt 80 suspends the back rest 71 in order to hold a baby in either a face-to-face manner or forward-facing manner. FIG. 6 shows the state used in a forward-facing holding manner;

In the baby carrier 2 according to the present embodiment, since the shoulder belt 80 is suspended on one of the shoulders, it is preferable for holding a baby in a stable manner that the carrier body 70 is disposed in the position slightly shifted so as to be away from the shoulder on which the shoulder belt is suspended.

In the baby carrier 2 used for holding a baby in both face-to-face and forward-facing manners according to the present embodiment, the carrier body 70 accommodating a baby is worn by the shoulder belt 80 and the waist belt 85. Therefore, the shoulder belt 80 and the waist belt 85 correspond to a wearing member defined in the present invention.

The width-reducing member comprising annular members and a gathering member shown in the first, second and fourth embodiments is not limited to the combination of loops and a string or the combination of rings and a double hook member, the width-reducing member according to the present invention may be the combination of loops and a double hook member, or the combination of rings and a string in the present invention.

Furthermore, as shown in the first and fourth embodiments, in the width-reducing member 50 and 90, only the loops 51 and the rings 91 as the annular members are fixed to the carrier body 10 and 70, and the string 52 and the double hook member 92 as the gathering members are not fixed to the carrier body 10 and 70. Therefore, it has advantages that design changes from the existing baby carrier are comparatively easy because of less number of members fixed to the carrier body, and that unnecessary members do not remain in the back rest 10 and 70 and the carrier body is less bulky in the case of the face-to-face holding. On the other hand, in the width-reducing member 60 in which the gathering member 62 is also fixed to the carrier body as shown in the second embodiment, it has an advantage that the gathering member 62 will never be lost.

Further, the loop 51 used as the annular member of the width-reducing member may be made of soft material such as knitted cord in place of a cloth as employed in the first embodiment. The soft material has an advantage that it can easily be sewn directly on the back rest 11 and it is not bulky. On the other hand, the rings 61 and 91 used in the second and fourth embodiments are made of hard material such as plastic or metal. The hard material has an advantage that it is easy to handle even if the ring is small suitable for being mounted to the back rests 11 and 71.

Furthermore, in the present invention, types of the width reducing member and its mounting position are not limited to the aforementioned four embodiments.

As to another width-reducing member, there may be a buckle fastener or a snap fastener in place of a string in the first embodiment, two D-rings and an adjusting belt like the aforementioned back-width adjusting member 16, buckle fasteners and snap fasteners attached in a predetermined distance, or strings to be tied attached in a predetermined distance.

As to a mounting position of the width-reducing member, in the first and second embodiments, since the shoulder belts 30 and 30 are sewn to the back surface of the back rest 11 in a V-shape manner and the annular members 51 and 61 and the shoulder belts 30 and 30 are attached at the same time, the right and left annular members are attached relatively close each other. However, the annular members may be attached near the opposite side ends of the back rest 11 so as to gather a large area in the width direction. In the present invention, the mounting position of the shoulder belts as a wearing member is not limited, and that the wearing member is not limited to the pair of right and left shoulder members, either.

Moreover, the structure of the carrier body and the wearing member used for holding a baby in both face-to-face and forward-facing manners is not limited to the aforementioned embodiments.

That is, the carrier body is not limited only if it can stably hold a baby in the face-to-face manner and the forward-facing manner. In the first, second and third embodiments, the carrier body 10 which can be changeable between the bag type and the open type by attaching and detaching the separable front rest 14 is described, but a baby carrier may be exclusively used as a bag type or an open type. Also, as described in the fourth embodiment, a baby carrier in which the carrier body consists of the back rest only can be used for holding a baby in both the face-to-face and the forward-facing manners.

Further, the number of members comprising the wearing member, the method of wearing, and the mounting position for the wearing member to the carrier body are not limited, only if the baby carrier accommodating a baby can be stably worn to the body of the user. In the case of using a pair:of shoulder belts as a wearing member as described in the first, second and third embodiments, the baby carrier can be used when a baby is held in a piggyback manner or a lateral manner. Also, a single belt can be used instead of a pair of shoulder belts for hanging on both shoulders and it can obtain the same effect as the pair of shoulder belts. As described in the fourth embodiment, the combination of a shoulder belt for suspending on one of the shoulders attached to the upper and lower ends of the carrier body and a waist belt can be used for a wearing member.

As mentioned above, according to the baby carrier used for holding a baby in both face-to-face and forward-facing manners according to the present invention, a baby can be stably held from its back to its buttocks using the back rest of the carrier body with its original width in the case of holding a baby in a face-to-face manner. Also, in the case of holding a baby in a forward-facing manner, the crotch-width is reduced by the width-reducing member to reduce the pressure against the inguinal region of the baby. Accordingly, a baby can be held safely and comfortably in either the face-to-face direction or the forward-facing direction.

In a case where the width-reducing member is the combination of a pair of right and left annular members attached to the back rest and a gathering member, the crotch-width can be reduced by engaging the gathering member with the right and left annular members.

In a case where the annular member is a loop made of soft material, the loop can be directly sewn to the back rest, resulting in an easy attachment. In a case where the annular member is a ring made of hard material, it can be easily handled despite a small size.

In a case where the gathering member is a string passed through the annular members, the crotch-width can be reduced by tightening the string. In a case where the gathering member is a double hook member, the crotch-width can be reduced by engaging the right and left hook member with the annular members. Further, in a case where the gathering member is fixed to the back rest, it will not be lost when the crotch-width is not reduced in a face-to-face holding manner. In a case where the gathering member is not fixed to the back rest, only the annular members are fixed to the back rest, the baby carrier is no bulky and easy to be changed in design from the existing baby carrier.

In a case where the width reducing member is a belt which is not fixed to the carrier body and can tighten the back rest, the crotch-width can be reduced without changing the carrier body from the existing baby carrier. Furthermore, in a case where the belt is mounted on a pad which protects the chest and abdomen of the baby, the pressure to the inguinal region and impact from outside are reduced, thereby enhancing the holding stability in a forward-facing holding manner.

The present invention claims a priority based on Japanese Patent Application No. 11-246877 filed on Sept. 1, 1999, the content of which is incorporated hereinto by reference in its entirety.

The terms and descriptions in this specification are used only for explanatory purposes and the present invention is not limited to these, but many modifications and substitutions may be made without departing from the spirit of the scope of the present invention which is defined by the appended claims.

What is claimed is:

1. A baby carrier used for holding a baby in both face-to-face and forward-facing manners, comprising:

a carrier body for accommodating a body of a baby; and a wearing member secured to said carrier body for wearing said carrier body on a body of a user, wherein said carrier body includes at least a back rest and is capable of accommodating and holding the baby in both a face-to-face holding manner in which the baby is held such that said back rest is brought into contact with a back of the baby and a forward-facing holding manner in which the baby is held such that said back rest is brought into contact with a chest and abdomen of the baby, wherein said back rest includes a width-reducing member for reducing a width of a lower portion of said back rest to be located between legs of the baby when the baby is held in a forward-facing holding manner wherein said width-reducing member comprises a pair of right and left annular members attached to a back of said back rest so as to be apart from each other at a predetermined distance and a gathering member for bringing said annular members close to each other by engaging with said annular members; and wherein said width-reducing member is separated from a lower edge of said carrier body by a seat portion of the carrier body, the seat portion being adjacent to said back rest.

2. The baby carrier used for holding a baby in both face-to-face and forward-facing manners as recited in claim 1, wherein said annular member is a loop-shaped member made of soft material.

3. The baby carrier used for holding a baby in both face-to-face and forward-facing manners as recited in claim 1, wherein said annular member is a ring made of hard material.

4. The baby carrier used for holding a baby in both face-to-face and forward-facing manners as recited in claim 1, wherein said gathering member is a string passed through said annular members for bringing said annular members close to each other by tightening thereof.

5. The baby carrier used for holding a baby in both face-to-face and forward-facing manners as recited in claim 2, wherein said gathering member is a string passed through said annular members for bringing said annular members close to each other by tightening thereof.

6. The baby carrier used for holding a baby in both face-to-face and forward-facing manners as recited in claim 3, wherein said gathering member is a string passed through said annular members for bringing said annular members close to each other by tightening thereof.

7. The baby carrier used for holding a baby in both face-to-face and forward-facing manners as recited in claim 1, wherein said gathering member is a double hook member having hooks at its opposite right and left ends to be hooked on said annular members, whereby said annular members are brought into a closed state when said double hook member is hooked on said annular members.

8. The baby carrier used for holding a baby in both face-to-face and forward-facing manners as recited in claim 2, wherein said gathering member is a double hook member having hooks at its opposite right and left ends to be hooked on said annular members, whereby said annular members are brought into a closed state when said double hook member is hooked on said annular members.

9. The baby carrier used for holding a baby in both face-to-face and forward-facing manners as recited in claim 3, wherein said gathering member is a double hook member having hooks at its opposite right and left ends to be hooked on said annular members, whereby said annular members are brought into a closed state when said double hook member is hooked on said annular members.

10. The baby carrier used for holding a baby in both face-to-face and forward-facing manners as recited in claim 4, wherein said gathering member is fixed to outside of said back rest so as to be located between said right and left annular members.

11. The baby carrier used for holding a baby in both face-to-face and forward-facing manners as recited in claim 5, wherein said gathering member is fixed to outside of said back rest so as to be located between said right and left annular members.

12. The baby carrier used for holding a baby in both face-to-face and forward-facing manners as recited in claim 6, wherein said gathering member is fixed to outside of said back rest so as to be located between said right and left annular members.

13. The baby carrier used for holding a baby in both face-to-face and forward-facing manners as recited in claim 7, wherein said gathering member is fixed to outside of said back rest so as to be located between said right and left annular members.

14. The baby carrier used for holding a baby in both face-to-face and forward-facing manners as recited in claim 8, wherein said gathering member is fixed to outside of said back rest so as to be located between said right and left annular members.

15. The baby carrier used for holding a baby in both face-to-face and forward-facing manners as recited in claim 9, wherein said gathering member is fixed to outside of said back rest so as to be located between said right and left annular members.

16. The baby carrier used for holding a baby in both face-to-face and forward-facing manners as recited in claim 4, wherein said gathering member is not fixed to outside of said back rest and is detached from said back rest.

17. The baby carrier used for holding a baby in both face-to-face and forward-facing manners as recited in claim 5, wherein said gathering member is not fixed to outside of said back rest and is detached from said back rest.

18. The baby carrier used for holding a baby in both face-to-face and forward-facing manners as recited in claim 6, wherein said gathering member is not fixed to outside of said back rest and is detached from said back rest.

19. The baby carrier used for holding a baby in both face-to-face and forward-facing manners as recited in claim 7, wherein said gathering member is not fixed to outside of said back rest and is detached from said back rest.

20. The baby carrier used for holding a baby in both face-to-face and forward-facing manners as recited in claim 8, wherein said gathering member is not fixed to outside of said back rest and is detached from said back rest.

21. The baby carrier used for holding a baby in both face-to-face and forward-facing manners as recited in claim 9, wherein said gathering member is not fixed to outside of said back rest and is detached from said back rest.

22. The baby carrier used for holding a baby in both face-to-face and forward-facing manners recited in claim 1, wherein said width-reducing member is separated and independent from said carrier body, and is a belt to be wound and fastened into a state in which said belt gathers up said back rest.

23. The baby carrier used for holding a baby in both face-to-face and forward-facing manners as recited in claim 22, wherein said belt is attached to a pad which is to be accommodated in said carrier body for protecting a chest and abdomen of the baby.

* * * * *